US012031411B1

(12) United States Patent
Clark et al.

(10) Patent No.: US 12,031,411 B1
(45) Date of Patent: Jul. 9, 2024

(54) DOWNHOLE CATCHING APPARATUS AND METHOD

(71) Applicant: Target Completions LLC, Broken Arrow, OK (US)

(72) Inventors: Joseph Clark, Lago Vista, TX (US); Michael Thomas Sommers, Broken Arrow, OK (US)

(73) Assignee: Target Completions LLC, Broken Arrow, OK (US)

( * ) Notice: Subject to any disclaimer, the term of this patent is extended or adjusted under 35 U.S.C. 154(b) by 0 days.

(21) Appl. No.: 18/408,715

(22) Filed: Jan. 10, 2024

(51) Int. Cl.
*E21B 40/00* (2006.01)

(52) U.S. Cl.
CPC ..... *E21B 40/001* (2020.05)

(58) Field of Classification Search
CPC ..... E21B 40/00; E21B 40/001
See application file for complete search history.

(56) References Cited

U.S. PATENT DOCUMENTS 2,802,534 A * 8/1957 Conrad ..... E21B 33/1292 166/134
3,179,180 A * 4/1965 Hart ..... E21B 17/06 166/216
3,189,096 A * 6/1965 Phenix ..... E21B 33/1294 166/138
3,664,417 A * 5/1972 Conrad ..... E21B 23/01 166/216
4,317,485 A * 3/1982 Ross ..... E21B 23/01 294/86.18
4,605,063 A * 8/1986 Ross ..... E21B 17/1035 166/216
4,765,403 A * 8/1988 Crawford ..... E21B 43/123 166/117.6
5,327,975 A * 7/1994 Land ..... E21B 33/0415 166/216
5,366,019 A * 11/1994 Brooks ..... E21B 23/006 166/387
5,771,969 A * 6/1998 Garay ..... E21B 31/20 166/214
9,890,603 B2 * 2/2018 Moore ..... E21B 40/001
2019/0186229 A1 * 6/2019 Hrupp ..... E21B 33/124
2020/0308921 A1 * 10/2020 Hrupp ..... E21B 43/261

OTHER PUBLICATIONS

Lufkin Don-Nan Print out of Information on Insert Pump Anachor-Assembly, Inspection and Operating Procedure.
Lufkin Don-Nan Print out of Information on Insert Pump Anchor—Pump Anchor for Set/Reset Pump Depth.

* cited by examiner

*Primary Examiner* — Shane Bomar
(74) *Attorney, Agent, or Firm* — Dennis D. Brown; Brown Patent Law, P.L.L.C.

(57) ABSTRACT

A catching tool assembly, and method of use, for catching an electric submersible pump string or other equipment string in a well bore in the event of a tubing failure. The catching tool is self-orienting so that the tool can be set and retrieved by simply moving the mandrel of the tool up and down, without any need to rotate the equipment string or the mandrel.

20 Claims, 5 Drawing Sheets

DOWNHOLE CATCHING APPARATUS AND METHOD

FIELD OF THE INVENTION

The present invention relates to downhole catching apparatuses and methods for catching electric submersible pumps and other equipment, and to well tubing assemblies which include catching apparatuses.

BACKGROUND OF THE INVENTION

A well tubing string assembly for an electric submersible pump (ESP) will typically comprise: an ESP tubing hanger; an ESP gas separator; an ESP (i.e., an electric submersible pump); a pump motor with an electric connection point; and an electric power cable which extends into the well from a wellhead having an ESP cable by-pass. The string assembly can also include pressure and temperature sensors, which are typically located at the lower end of the string.

Another tool which is sometimes included in the ESP string assembly is an ESP catcher. The catching apparatus (a) will typically include drag blocks or other drag elements and (b) will typically be positioned in the ESP string assembly below the submersible pump. The catcher works to catch the pump and related ESP equipment in the event of a tubing failure which causes the equipment to fall in the well. ESP catchers have the potential, for example, of being beneficial in horizontal completions to prevent the ESP equipment from falling out of the vertical portion of the well into a horizontal leg. If the ESP equipment is not retained in the vertical portion of the well, the fishing and retrieval operations for recovering the ESP equipment are much more difficult.

The ESP catchers heretofore used in the art have typically required that the tubing string be rotated in order to set the tool. However the entire tool cannot be rotated without also having to rotate the drag elements of the tool which are frictionally engaged against the ID of the well casing. Moreover, the rotation of the tubing string assembly also twists the electrical cable which runs into the well for powering the pump motor.

Another type of ESP catcher heretofore known in the art uses a mandrel with a J-slot milled therein for cycling the tool by up and down movement. However, because the J-pin which engages the J-slot must remain in the J-slot for the entire stroke of the mandrel when setting or releasing the tool, the J-slot must typically extend for a length of several feet. The "stroke" of the mandrel is defined as the length of downward travel of the mandrel from the run-in position of the mandrel to the point at which the slip engaging element(s) carried on the mandrel engage(s) the slips of the catcher.

This significantly increases the cost and complexity of forming the tool, and will also commonly result in the total stroke length of the mandrel being less than would otherwise be desired. In addition, these tools typically require that the mandrel be rotated to at least some degree during the setting and/or retrieval operations.

Therefore, a need exists for an improved catcher for ESP string assemblies and other equipment which (a) eliminates the need to rotate the string assembly and/or the mandrel of the catcher, (b) eliminates the necessity of milling a J-slot in the mandrel which must extend for a length of several feet, (c) is less costly to produce and much simpler to manufacture and use; and (d) is more effective and reliable than prior tools.

SUMMARY OF THE INVENTION

The present invention provides a catching tool and method which satisfy the needs and alleviate the problems discussed above. When setting and retrieving the inventive catcher, it is only necessary that the string assembly and the mandrel of the tool be moved up and down. No rotation of the string assembly or the mandrel of the catcher is required. In addition, because the inventive catcher is self-orienting and does not depend upon the constant engagement of a J-pin in a J-slot over the entire length of the stroke of the tool, the inventive catcher requires only the use of a yo-yo slot which will typically be about 12 inches or less in length.

In one aspect, there is provided an apparatus for catching falling equipment in a well. The apparatus preferably comprises: (a) a cylindrical mandrel having a longitudinal axis and (b) a catching assembly through which the cylindrical mandrel extends for sliding longitudinal movement of the cylindrical mandrel through the catching assembly. The catching assembly preferably comprises: (i) a drag assembly comprising one or more drag elements (e.g., drag blocks or other drag elements) which will contact the cased or an uncased portion of the bore of the well to resist downward and upward movement of the catching assembly in the well and (ii) a slot engaging element which is positioned longitudinally below the one or more drag elements.

In addition, the catching apparatus preferably comprises a setting device, below the one or more drag elements, which is retained on and moves longitudinally with the cylindrical mandrel. Also, it is preferred that (a) the slot engaging element be rotatable, with respect to the one or more drag elements, around the mandrel and/or (b) the setting device be rotatable around the mandrel.

The setting device of the catching apparatus preferably provides a slot around the cylindrical mandrel for interacting with the slot engaging element by longitudinally retracting and extending the cylindrical mandrel through the catching assembly, without rotation of the mandrel, so that (i) as the cylindrical mandrel is retracted longitudinally upward through the catching assembly, the slot engaging element is automatically received in an upper opening of the slot, (ii) as the cylindrical mandrel continues to be retracted longitudinally upward, the slot engaging element is automatically stopped at a first lower catch position of the slot which prevents the cylindrical mandrel from being further retracted upwardly through the catching assembly, (iii) if the cylindrical mandrel is then extended longitudinally downward through the catching assembly, the slot engaging element is automatically stopped at an upper catch position of the slot which prevents the cylindrical mandrel from being further extended longitudinally downward through the catching assembly, (iv) if the cylindrical mandrel is then retracted longitudinally upward through the catching assembly, the slot engaging element is automatically stopped at a second lower catch position of the slot which prevents the cylindrical mandrel from being further retracted upwardly through the catching assembly, and (v) if the cylindrical mandrel is then extended longitudinally downward through the catching assembly, the slot engaging element will automatically travel out of the upper opening of the slot so that the slot engaging element is no longer positioned in the slot and the cylindrical mandrel can be further extended downwardly through the catching assembly.

In another aspect, there is provided a string assembly for a well comprising (a) an electric submersible pump and (b) a catching tool positioned in the string assembly below or above (more preferably below) the electric submersible pump. The catching tool will preferably be a catching apparatus of the type described above.

In another aspect, there is provided a method of running and/or retrieving an electric submersible pump in a well, wherein the well has an internal surface which is (i) an interior surface of a casing in the well or (ii) a wall of an uncased portion of the borehole of the well. The method preferably comprises the step (a) of forming a string assembly comprising the electric submersible pump and a catching tool positioned below or above the electric submersible pump. The catching tool preferably comprises: (1) a cylindrical mandrel having a longitudinal axis and (2) a catching assembly through which the cylindrical mandrel extends for sliding longitudinal movement of the cylindrical mandrel through the catching assembly. The catching assembly of the catching tool preferably comprises: (i) a drag assembly comprising one or more drag elements (e.g., drag blocks or other drag elements) which contact the internal surface of the well to resist downward and upward movement of the catching assembly in the well, (ii) a plurality of slips positioned above the one or more drag elements, and (iii) a slot engaging element which is positioned longitudinally below the one or more drag elements.

The catching tool used in the method preferably also comprises: (3) a setting device, below the one or more drag elements, which is retained on and moves longitudinally with the cylindrical mandrel and provides a slot around the cylindrical mandrel for interacting with the slot engaging element, (4) one or more slip engaging elements carried on the cylindrical mandrel, the one or more slip engaging elements being receivable under the slips for forcing the slips outwardly against the internal surface of the well, and (5) the slot engaging element being rotatable, with respect to the one or more drag elements, around the mandrel and/or the setting device being rotatable around the mandrel.

In addition, the method preferably also comprises the further steps, following step (a), of: (b) longitudinally retracting the cylindrical mandrel upwardly through the catching assembly, without rotating the cylindrical mandrel, so that the slot engaging element is automatically received in an upper opening of the slot; (c) continuing to retract the cylindrical mandrel upwardly through the catching assembly, without rotating the cylindrical mandrel, until the slot engaging element automatically contacts and is stopped at a lower catch position of the slot which prevents the cylindrical mandrel from being further retracted upwardly through the catching assembly; (d) delivering the string assembly into the well such that, as the string assembly is delivered into the well and the one or more drag elements contact the internal surface of the well, the cylindrical mandrel extends downwardly through the catching assembly, without rotation of the cylindrical mandrel, until the slot engaging element automatically contacts and is stopped at an upper catch position of the slot; and then (e) continuing to deliver the string assembly into the well with the slot engaging element being stopped at the upper catch position of the slot which (i) pulls the catching assembly into the well with the cylindrical mandrel, (ii) prevents the cylindrical mandrel from being further extended downwardly through the catching assembly, and (iii) prevents the one or more slip engaging elements from moving into engagement with the slips.

In another aspect, the method of running and/or retrieving an electric submersible pump in a well can further comprise the catching assembly being delivered to a desired depth in the well in step (e), followed by: performing a step (f) of retracting the cylindrical mandrel longitudinally upward through the catching assembly, without rotating the cylindrical mandrel, until the slot engaging element is automatically stopped at a second lower catch position of the slot which prevents the cylindrical mandrel from being further retracted upwardly through the catching assembly; performing a step (g), following step (f), of extending the cylindrical mandrel longitudinally downward through the catching assembly, without rotating the cylindrical mandrel, so that the slot engaging element automatically travels out of the upper opening of, and is no longer position in, the slot; and performing a step (h), following step (g), of continuing to extend the cylindrical mandrel longitudinally downward through the catching assembly to lower the one or more slip engaging elements to a position which is closer to the catching assembly but at which the one or more slip engaging elements are spaced apart from and do not engage the slips.

In another aspect, the method of running and/or retrieving an electric submersible pump in a well can further comprise steps, following step (h), of retrieving the string assembly from the well by: (1) pulling the cylindrical mandrel longitudinally upward through the catching assembly, without rotation of the cylindrical mandrel, so that the slot engaging element is automatically received in the upper opening of the slot; (2) continuing to pull the cylindrical mandrel upwardly through the catching assembly, without rotating the cylindrical mandrel, so that the slot engaging element is automatically received at the first lower catch position of the slot to prevent the cylindrical mandrel from being further retracted longitudinally upward through the catching assembly; and then (3) continuing to pull the cylindrical mandrel upwardly with the slot engaging element being caught at the first lower catch position of the slot which (i) pulls the catching assembly upwardly with the mandrel and (ii) lifts the string assembly out of the well.

Further aspects, features, and advantages of the present invention will be apparent to those in the art upon examining the accompanying drawings and upon reading the following detailed description of the preferred embodiments.

DETAILED DESCRIPTION OF THE PREFERRED EMBODIMENTS

Figure 1:
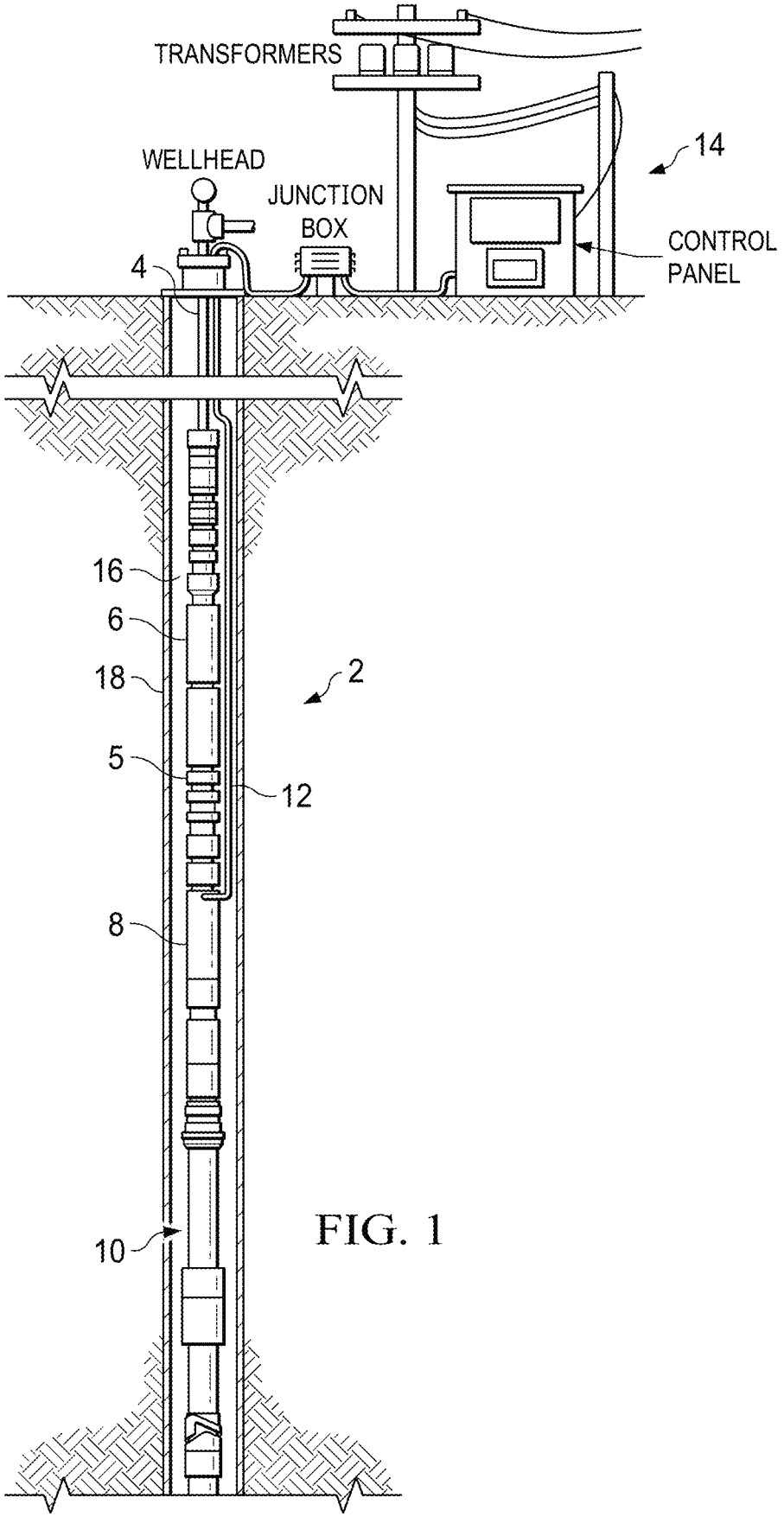
FIG. 1 schematically illustrates an embodiment 2 of an ESP string assembly provided by the present invention.

An embodiment 2 of an ESP string assembly provided by the present invention is illustrated in FIG. 1. The inventive string assembly 2 can extend from generally any type of well tubing string 4. The string assembly 2 preferably comprises: a gas separator 5; an electric submersible pump (ESP) 6; a pump motor 8 below the pump 6; an inventive catching tool apparatus 10 below the pump motor 8; and an electric power cable 12 which extends from an above-ground power source 14 to the pump motor 8. The inventive catcher 10 can be installed in the string assembly 2 using a screwed connection, a flanged connection, or any other type of connection desired, and can alternatively be installed in the string assembly 2 above, rather than below, the ESP 6.

As illustrated in FIG. 1, the inventive ESP string assembly 2 extends into a well 16 having a casing 18 therein. However, it will be understood that the inventive string assembly 2 can alternatively be extended into an uncased portion of a well such that the drag elements 38 of the drag assembly 36 of the inventive catching tool 10 will contact the wall of the uncased bore of the well. In addition, it will also be understood that: (i) some of the elements shown in the string assembly 2 of FIG. 1 can optionally be excluded, (ii) temperature sensors, pressure sensors, and/or other sensors or components can optionally be added to the string assembly 2, and (iii) the inventive catching tool 10 can also be used in other types of downhole string assemblies which do not include ESPs.

Figure 2:
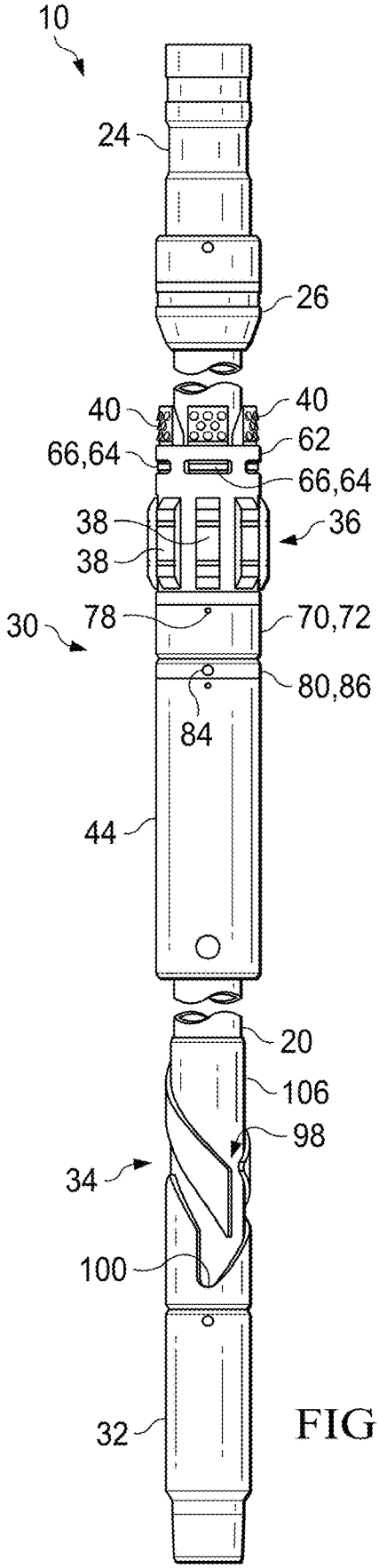
FIG. 2 is an elevational view of an embodiment 10 of the catching tool apparatus provide by the present invention.
Figure 3:
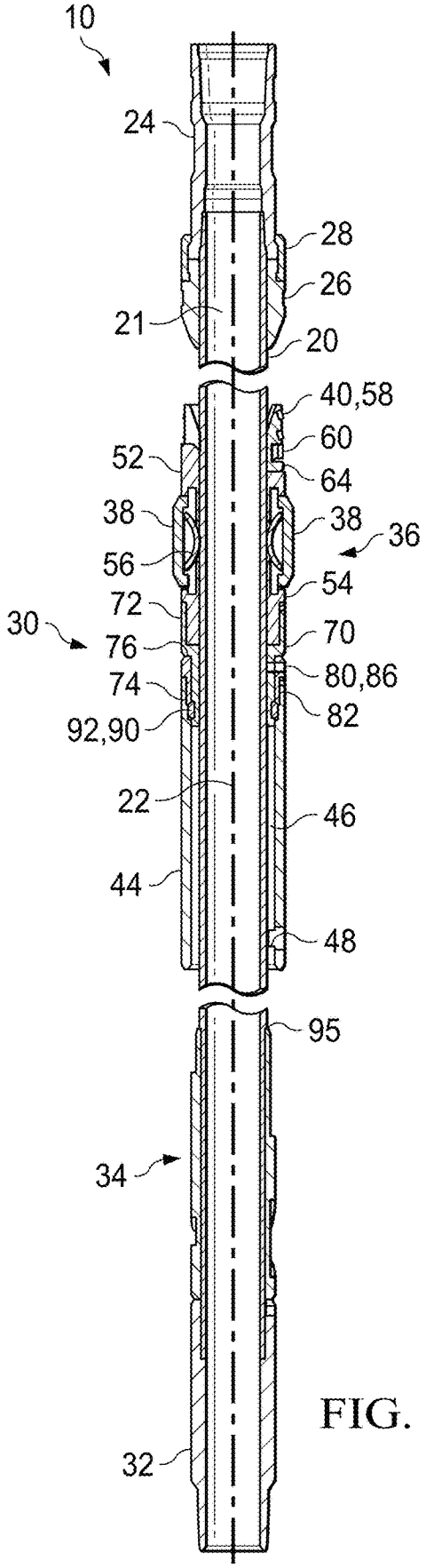
FIG. 3 is a cutaway elevational view of the catching tool 10.
Figure 6:
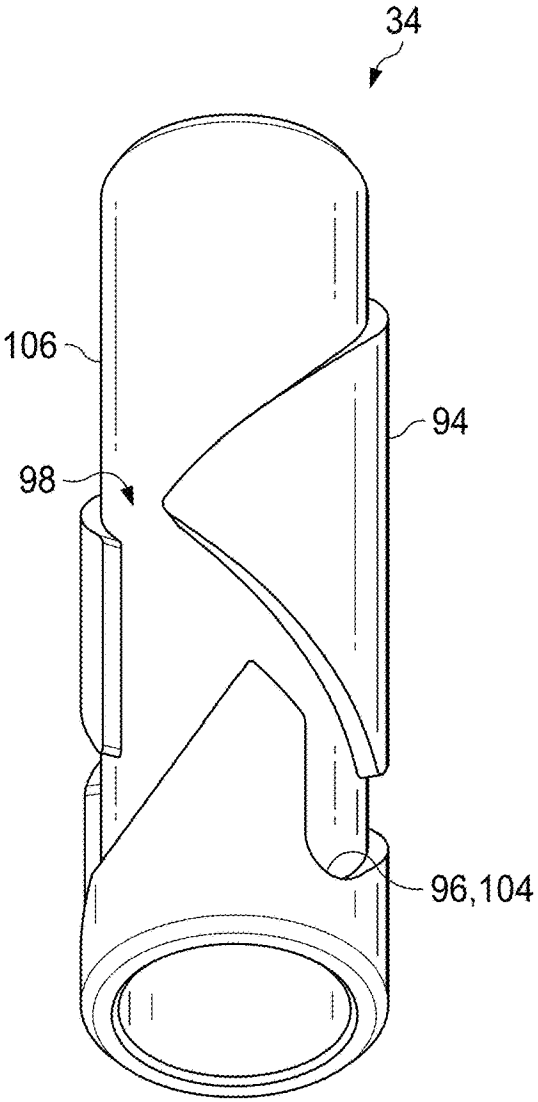
FIG. 6 is a third perspective view of the setting device 34.
Figure 5:
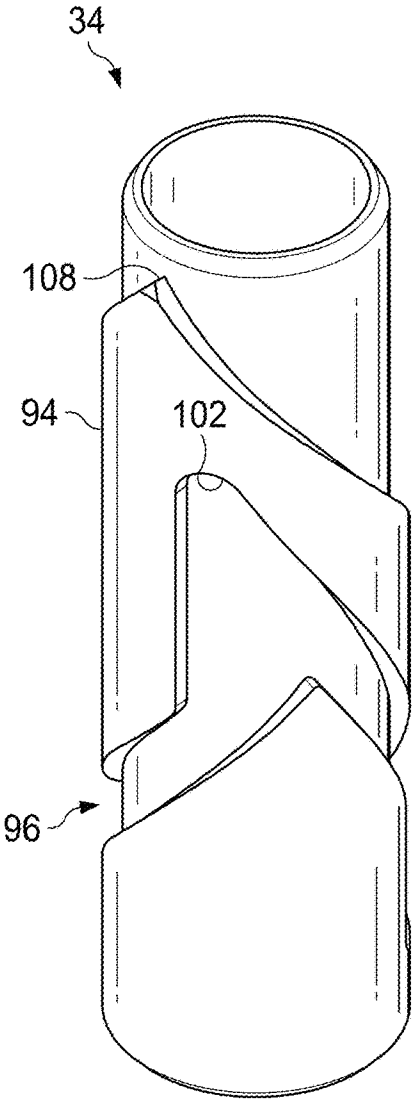
FIG. 5 is a second perspective view of the setting device 34.
Figure 4:
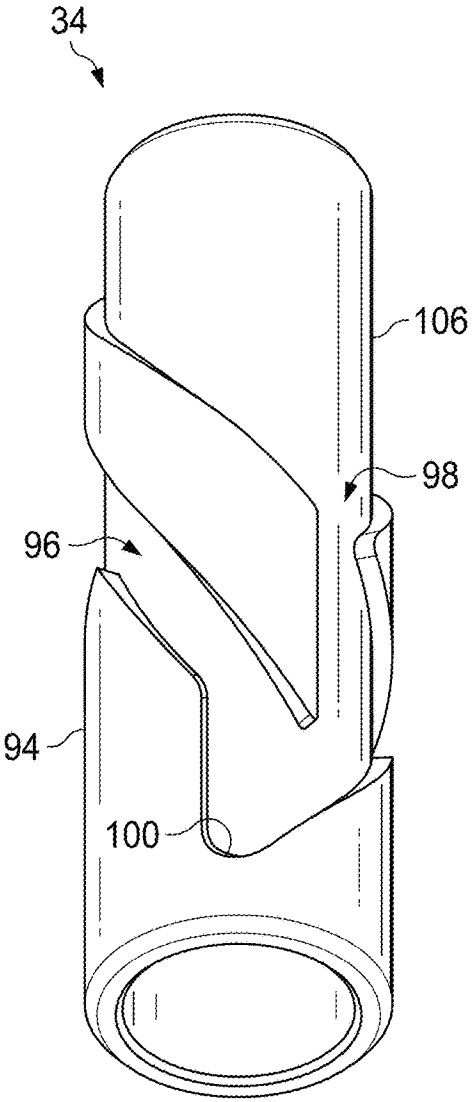
FIG. 4 is first a perspective view of a setting device 34 used in the catching tool 10.

As illustrated in FIGS. 2 and 3, the inventive catching tool apparatus 10 preferably comprises: (i) a cylindrical mandrel 20 having a flow passage 21 therethrough and a longitudinal axis 22; (ii) a top sub 24 on the upper end of the mandrel 20; (iii) a slip-activating cone element 26, below the top sub 24, which is secured to the lower end of the top sub 24 by a cone cap 28; (iv) a catching assembly 30 through which the cylindrical mandrel 20 extends for sliding longitudinal movement of the cylindrical mandrel 20 through the catching assembly 30; (v) a bottom sub 32 on the bottom end of the cylindrical mandrel 20; and (vi) a setting device 34 install in fixed longitudinal position on the cylindrical mandrel 20 above the bottom sub 32.

It will be understood that terms such as up and down, top and bottom, above and below, upward and downward, upwardly and downwardly, and upper and lower, as used herein and in the claims, merely refer to the orientation of the inventive ESP string assembly 2 and the inventive catching tool 10 when positioned in a vertical portion of the well 16.

The catching assembly 30 of the inventive tool 10 preferably comprises: a drag assembly 36 having one or more drag elements 38 (e.g., drag blocks or other drag elements); a plurality of slips 40 which are positioned above the one or more drag elements 38; a longitudinally extending control sleeve 44 positioned around the cylindrical mandrel 20 below the one or more drag elements 38; a longitudinally extending annular space 46, formed between the interior surface of the control sleeve 44 and the exterior of the cylindrical mandrel 20, which surrounds the exterior of the mandrel 20; and a slot engaging element 48 (e.g., a pin, cam, or other element) which is located below the one or more drag elements 38 and preferably extends inwardly from the interior surface of the control sleeve 44, at or near the lower end thereof, toward the exterior of the cylindrical mandrel 20.

The setting device 34 on the lower end of the mandrel 20 is removably received in the longitudinally extending annular space 46 within the control sleeve 44 when the mandrel 20 is retracted upwardly through the catching assembly 30 of the inventive catching tool 10.

The one or more drag elements 38 of the drag assembly 36 contact the internal surface 42 of the well 16 (i.e., either the interior wall of a casing 18 in the well 16 or the wall of an uncased portion of the borehole of the well 16) to resist downward and upward movement of the catching assembly 30 in the well 16. Examples of drag elements 38 suitable for use in the catching assembly 36 of the inventive catching tool 10 include, but are not limited to, drag blocks, drag springs, drag pads, or slips.

The drag assembly 36 preferably comprises a plurality of drag blocks 38 which project radially outward from a corresponding number of windows formed around a drag block body 52. The drag blocks 38 are retained in the drag block body 52 by a surrounding retainer 54 which is positioned over the lower ends of the drag blocks 38. The drag blocks 38 are continuously urged outwardly toward engagement with the internal surface 42 of the well 16 by leaf springs 56 or other biasing elements positioned within the drag block body 52.

The slips 40 of the catching assembly 30 preferably comprise: (i) upper engaging portions 58 which project from the top end of the drag block body 52, (ii) lower intermediate portions 60 which extend downwardly from the upper engaging portions 58 within a surrounding upper rim 62 of the drag block body 52; and bottom lips 64 which extend radially outward into a corresponding number of surrounding apertures 66 formed through upper portion of the drag block body 52. The upper engaging portions 58 of the slips 40 are continuously urged radially inward, away from engagement with the internal surface 42 of the well 16, by slip springs or other biasing elements positioned inside the surrounding upper rim 62 of the drag block body 52.

The catching assembly 30 of the inventive tool 10 further comprises a connector body 70 between the drag block body 52 and the control sleeve 44. The connector body 70 comprises (1) an upper portion 72 of greater inside and outside diameter which extends over the lower end portion of the drag block body 52, (2) a lower portion 74 of lesser inside and outside diameter which extends downwardly from the upper portion 72, and (3) a downwardly facing, outer radial shoulder 76 which is formed by the transition from the upper portion 72 to the lower portion 74. The upper portion 72 of the connector body 70 is attached to the lower portion of the drag block body 52 by, e.g., a socket screw 78 or other attachment.

In order for the inventive catching tool apparatus 10 to be self-orienting, either (i) the setting device 34 will be rotatable around the cylindrical mandrel 20, (ii) the slot engaging element 48 will be rotatable, with respect to the one or more drag elements 38, around the mandrel 20, or (iii) the setting device 34 and the slot engaging element 48 will each be rotatable. More preferably, at least the setting device 34, and most preferably both the setting device 34 and the slot engaging element 48, will be rotatable around the cylindrical mandrel 20.

To provide for the rotation (also referred to as "swiveling") of the control sleeve 44 and the slot engaging element 48, the upper end portion of the control sleeve 44 is preferably rotatably mounted on the lower portion 74 of the connector body 70 using a control sleeve cap 80. The sleeve cap 80 has (i) a lower end portion 82 over which the upper portion of the control sleeve 44 extends and to which the upper end portion of the control sleeve 44 is attached using a socket set screw 84 or other attachment and (ii) an upper end 86 of greater outside diameter.

The upper end 86 of the sleeve cap 80 rotatably abuts the downwardly facing radial shoulder 76 of the connector body 70 so that the radial shoulder 76 permits rotation around the mandrel 20 but prevents the control sleeve 44 and the slot engaging element 48 from moving longitudinally upward in the catching assembly 30 toward the one or more drag elements 38. At the same time, the bottom end of the lower end portion 82 of the sleeve cap 80 rotatably abuts a split ring 90 which projects radially outward from a groove 92 formed around the lower portion 74 of the connector body 70 so that the radially projecting split ring 90 permits rotation around the mandrel 20 but prevents the control sleeve 44 and the slot engaging element 48 from moving longitudinally downward in the catching assembly 30 away from the one or more drag elements 38.

The setting device 34 comprises a cylindrical tube 94 with a slot 96 formed around the exterior of the tube 94 for removably receiving and interacting with the slot engaging element 48 of the catching assembly 30. The slot 96 may also be referred to as a yo-yo slot in view of the fact that the cylindrical mandrel 20 and the slot engaging element 48 of the catching tool 10 are capable of interacting with the slot 96 for setting and retrieving the inventive catcher 10 by simple moving the mandrel 20 up and down (retracting and extending the mandrel 20) through the catching assembly 30 of the tool 10.

The setting device 34 is preferably rotatably mounted in fixed longitudinal position on the cylindrical mandrel 20 between (i) a downwardly facing radial shoulder 95 which is formed around the mandrel 20 and is rotatably abutted by the upper end of the setting device 34 so that the setting device is prevented from moving longitudinally upward on the mandrel 20 and (ii) the upper end of the bottom sub 32 which is rotatably abutted by the lower end of the setting device 34 so that the setting device 34 is prevented from moving longitudinally downward on the mandrel 20.

Figure 7:
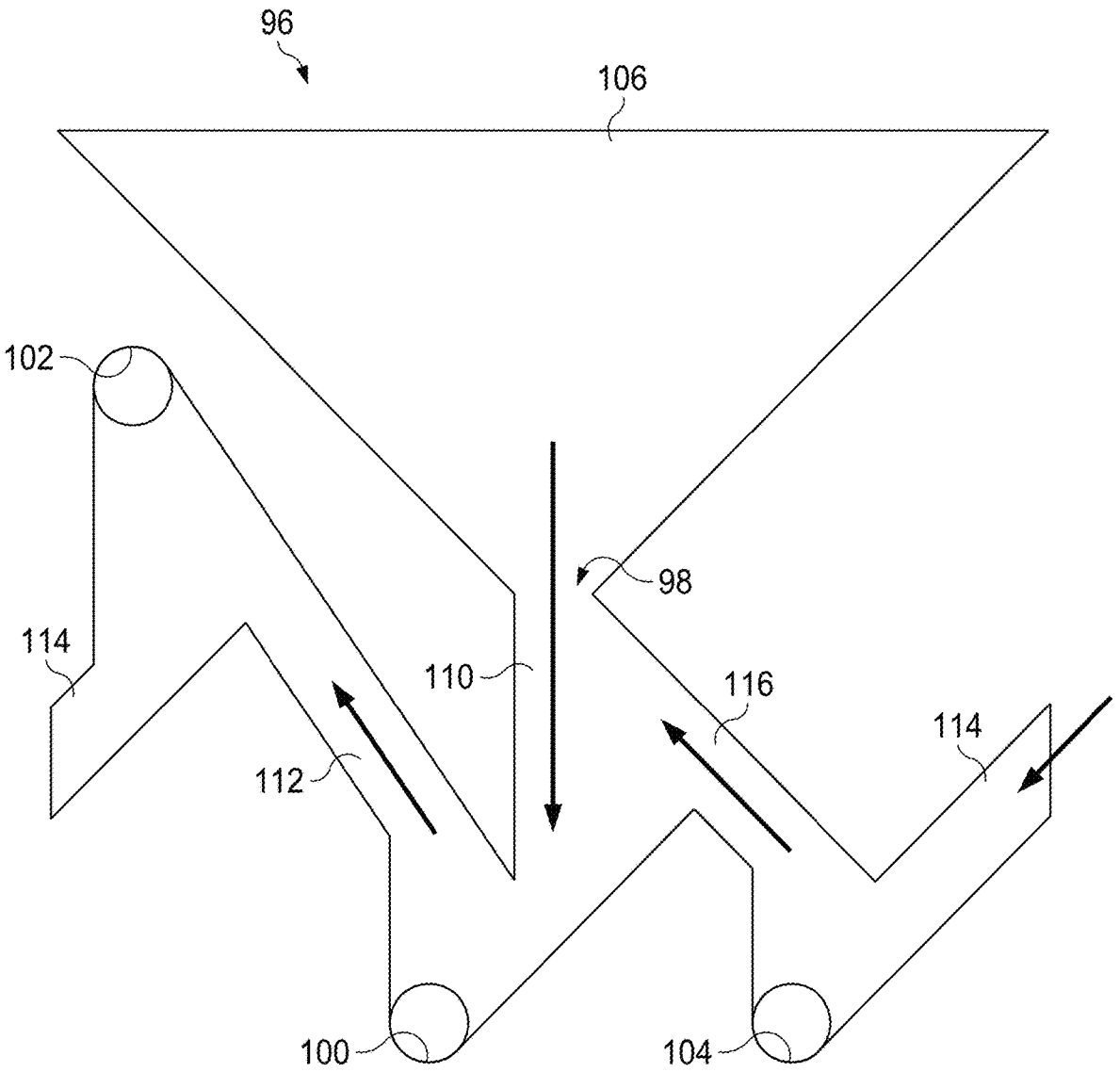
FIG. 7 schematically illustrates a yo-yo slot 96 of the setting device 34 as it would appear if laid out flat.

The slot 96 of the setting device 34 is shown as surrounding the setting device 34 in FIGS. 2 and 4-6 but is seen in FIG. 7 as it would appear if laid flat. The slot 96 comprises: (a) an upper opening 98; (b) a first lower catch position 100; (c) an upper catch position 102; and (d) a second lower catch position 104. The slot 96 also includes an upper guide funnel portion 106 wherein, when the slot 96 is wrapped around the setting device 34, the top of the upper guide funnel 106 forms a point 108 on the side of the setting device 34 opposite the upper opening 98 of the slot 96.

The pointed upper guide funnel 106 of the slot 96, along with the rotatable mounting of (i) the setting device 34 and/or (ii) the slot engaging element 48, make the inventive catching tool apparatus 10 "self-orienting" so that, whenever the cylindrical mandrel 20 is retracted upwardly through the catching assembly 30, the slot engaging element 48 will automatically travel into the pointed upper funnel 106 of the slot 96 and will be guided by the upper guide funnel 106 into the upper opening 98 of the slot 96.

The slip-activating cone element 26 on the upper end portion of the mandrel of 20 is a preferred type of slip engaging element which is receivable under the slips 40 for forcing the slips outwardly into an engagement position with the internal surface 42 of the well 16. It will be understood, however, that one or more slip engaging elements of a different type can alternatively be used in the inventive catching tool 10. Example's of other types of slip engaging elements suitable for use in the inventive catcher 10 include, but are not limited to, service tools, production packers, and liner handers.

The drag blocks or other drag elements 38 of the inventive catching tool 10, as well as the slips 40, will preferably have carbide inserts which bite the casing 18 or other internal surface 42 of the well 16 to provide enhanced slip resistance for the catching assembly 30 of the inventive tool 10.

When an inventive string assembly 2 is run into the well 16 to a desired depth, the cone 26 or other slip-engaging element(s) of the catching tool 10 will be lowered toward the slips 40, if needed, so that the slip-engaging element(s) is/are spaced at a desired drop distance above the slips 40. The drop distance of the slip-engaging element(s) 26 above the slips 40 will preferably be in a range of from about 5 to about 10 feet or whatever spacing is desired. It will be understood that, depending upon the mandrel length desired, the mandrel 20 can be formed of a single mandrel segment or of a series of two or more mandrel segments linked together.

The term "about", when used herein and in the claims in reference to a length or distance means, ±5%.

If the tubing which hangs the string assembly 2 in the well fails, the ESP 6 and/or other components of the string assembly 2, as well as the mandrel 20 of the inventive catching tool 10, will fall. However, the drag elements 38 of the catching assembly 30 of the tool 10 will hold the catching assembly 30 in place in the well 16 so that the falling cone or other slip engaging element(s) 26 of the tool 10 will engage the slips 40 and force them outwardly into engagement with the casing 18 or other internal surface of the well 16, thus bringing all of the falling equipment to a dead stop.

The present invention allows the use of an internal mandrel 20 of increased length, thus providing a longer available stroke. Increasing the length of the stroke of the catching tool 10 is beneficial for reaching a greater depth in the well 16 as may be desired in view of well conditions, operator requirements, and other considerations, and to compensate for tubing movement. The length of the stroke of the inventive catcher 10 will preferably be at least 60 inches and the length of the mandrel 20 will preferably be in the range of from 10 feet to 15 feet or more. In the inventive catching tool 10, a mandrel length of 10 feet will provide a maximum stroke of about 85 inches. A mandrel length of 15 feet will provide a maximum stroke of about 145 inches. A mandrel length of 20 feet will provide a maximum stroke of about 205 inches.

The ability to significantly increase the stroke and improve the operation of the inventive catching tool 10 is provided by the self-orienting operation of the setting device 34 and/or the slot engaging element 48, and by the unique configuration of the yo-yo slot 96 of the tool 10. The longitudinal length of the setting device 34 will preferably be not more than 20 inches, more preferably not more than 18 inches, and will typically be about 12 inches.

The cylindrical wall of the mandrel 20 of the inventive catching tool 10 will typically be a solid cylindrical wall. However, the mandrel 20 can alternatively have a perforated cylindrical wall in order to provide increase flow of the well fluid to the ESP 6.

The bottom sub 32 of the inventive catching tool 10 can be replaced with an alternative component such as, but not limited to, an EUE connection, a mule shoe, a bull plug, or a pup joint.

It will also be understood that, rather than using a control sleeve 44, the slot engaging element 48 of the catching assembly 30 can alternatively be rotatably or non-rotatably held in the catching assembly 30 below the one or more drag elements 30 in any other manner desired.

In the method of the present invention, the ESP string assembly 2, or other ESP or non-ESP string assembly which includes the inventive catching tool 10, is formed and then run into the well 16. The inventive method can also include the later retrieval of the string assembly 2 from the well 16.

To run the string assembly 2 into the well 16, the cylindrical mandrel 20 of the self-orienting catching tool 10 is preferably first retracted longitudinally upward through the catching assembly 30 of the tool 10 so that the slot engaging element 48 of the catching assembly 30 is automatically guided by the upper guide funnel 106 of the slot 96 of the setting device 34 into the upper opening 98 of the slot 96. Then, the retraction of the mandrel 20 upwardly through the catching assembly 30 is continued such that the downward track 110 of the slot 96 automatically guides the slot engaging element 48 into contact with the first lower catch position 100 of the slot 96. This stops the travel of the slot engaging element 48 in the slot 96 and thereby prevents the cylindrical mandrel 20 from being further retracted upwardly through the catching assembly 30.

The string assembly 2 is then inserted into the well 16 such that the drag elements 38 come into frictional contact with the casing 18 or other internal surface 42 of well 16. This frictional contact momentarily stops the downward movement of the catching assembly 30 of the tool 10 so that the continued movement of the remainder of the string 2 down the well 16 causes the mandrel 20 to momentarily extend downwardly through the catching assembly 30. As this momentary downward extension of the mandrel 20 through the catching assembly 30 occurs, the first upward track 112 of the slot 96 automatically guides the slot engaging element 48 from the first lower catch position 100 to the upper catch position 102. When the slot engaging element 48 contacts the upper catch position 102 of the slot 96, the momentary downward extension of the mandrel 20 through the catch assembly 30 is stopped.

With the slot engaging element 48 stopped at the upper catch position 102 of the slot 96, the continued insertion of the string assembly 2 into the well 16 now (a) pulls the catching assembly 30 of the inventive tool 2 into the well 16 with the mandrel 20 and the remainder of the string assembly 2 and thereby also (b) prevents the slip engaging element(s) 26 from moving into engagement with the slips 40.

Once the string assembly 2 is delivered to a desired depth in the well 16, with the drag elements 38 of the catching assembly 30 of the tool 10 retaining the catching assembly 30 at a substantially fixed vertical location, the inventive catching tool 10 is set by lifting the assembly 2 so that the cylindrical mandrel 20 is retracted upwardly through the catching assembly 30 a sufficient distance whereby the second downward track 114 of the slot 96 automatically guides the slot engaging element 48 into contact with the second lower catch position 104 of the slot 96, which stops and prevents the cylindrical mandrel 20 from being further retracted upwardly though the catching assembly 30.

Next, the sting assembly 2 is lowered so that the mandrel 20 is extended downwardly through the catching assembly 30. As the mandrel 20 is extended downwardly through the catching assembly 30, the second upward track 116 of the slot 96 automatically guides the slot engaging element 48 upwardly from the second lower catch position 104 of the slot 96 toward, and out of, the upper opening 98 of the slot 96. Then, with the catching assembly 30 set by the drag elements 38 in fixed position at the desired location in the well 16, the operator can continue to lower the string assembly 2 so that the mandrel 20 continues to be extended downwardly through the catching assembly 30. The lowering of the string assembly 2 continues until the cone 26 or other slip engaging element(s) is/are located at a desired drop distance above the slips 40.

In order to later retrieve the string assembly 2 from the well 16, the string assembly 2 is lifted upwardly so that (i) mandrel 20 of the inventive tool 10 is retracted upwardly through the catching assembly 30, (ii) the upper guide funnel 106 of the slot 96 of the setting device 34 automatically receives and guides the slot engaging element 48 through the upper opening 98 of the slot 96, and (iii) the first downward track 110 of the slot 96 automatically guides the slot engaging element 48 into engagement with the first lower catch position 100 of the slot 96, which prevents the cylindrical mandrel 20 from being further retracted longitudinally upward through the catching assembly 30.

Then, with the slot engaging element 48 being caught in the first lower catch position 100 of the slot 96, the operator continues to pull the string assembly 2 and the cylindrical mandrel 20 upwardly so that the catching assembly 30 is also pulled upwardly and the string assembly 2 is eventually pulled out of the well 16.

If the string assembly 2 has fallen in the well 16 so that the cone 26 or other slip engaging element(s) has/have engaged the slips 40 and are holding the slips 40 in an outward engaging position, a fishing operation will typically first be required in order to reestablish a connection with the fallen string 2. However, once a connection to the fallen string assembly 2 is again established, the string assembly 2 and the inventive catching tool 10 will be retrieved from the well 16 in the same way. As the string assembly 2 is lifted, the mandrel 20 will be automatically retracted upwardly through the catching assembly 30 whereby the slip engaging element(s) 26 will be lifted out of engagement with the slips 40. In addition, the slip springs will also act to inwardly retract the slips 40 away from engagement.

Each of the steps of the inventive method described above will preferably be performed without rotating the string assembly 2 or the mandrel 20 of the inventive catching tool 10.

Thus, the present invention is well adapted to carry out the objectives and attain the ends and advantages mentioned above as well as those inherent therein. While presently preferred embodiments have been described for purposes of this disclosure, numerous changes and modifications will be apparent to those in the art. Such changes and modifications are encompassed within the invention as defined by the claims.

What is claimed is:

1. An apparatus for catching falling equipment in a well, the apparatus comprising:

a cylindrical mandrel having a longitudinal axis;

a catching assembly through which the cylindrical mandrel extends for sliding longitudinal movement of the cylindrical mandrel through the catching assembly, the catching assembly comprising a drag assembly comprising one or more drag elements which will contact a cased or uncased portion of a bore of the well to resist downward and upward movement of the catching assembly in the well and a slot engaging element which is positioned longitudinally below the one or more drag elements;

a setting device, below the one or more drag elements, which is retained on and moves longitudinally with the cylindrical mandrel;

the slot engaging element being rotatable, with respect to the one or more drag elements, around the mandrel and/or the setting device being rotatable around the mandrel; and the setting device providing a slot which interacts with the slot engaging element by longitudinally retracting and extending the cylindrical mandrel through the catching assembly without requiring rotation of the mandrel so that (i) as the cylindrical mandrel is retracted longitudinally upward through the catching assembly, the slot engaging element is automatically received in an upper opening of the slot, (ii) as the cylindrical mandrel continues to be retracted longitudinally upward, the slot engaging element is automatically stopped at a first lower catch position of the slot, (iii) if the cylindrical mandrel is then extended longitudinally downward through the catching assembly, the slot engaging element is automatically stopped at an upper catch position of the slot, (iv) if the cylindrical mandrel is then retracted longitudinally upward through the catching assembly, the slot engaging element is automatically stopped at a second lower catch position of the slot, and (v) if the cylindrical mandrel is then extended longitudinally downward through the catching assembly, the slot engaging element will automatically travel out of the upper opening of the slot so that the slot engaging element is no longer positioned in the slot and the cylindrical mandrel can be further extended downwardly through the catching assembly.

2. The apparatus of claim 1 further comprising the setting device being rotatable around the mandrel.

3. The apparatus of claim 1 further comprising:

the catching assembly also including a longitudinally extending control sleeve positioned below the one or more drag elements and around the cylindrical mandrel, a longitudinally extending annular space formed between an interior surface of the control sleeve and an exterior of the cylindrical mandrel, the longitudinally extending annular space surrounding the exterior of the cylindrical mandrel, the slot engaging element extending inwardly from the interior surface of the control sleeve toward the exterior of the cylindrical mandrel, and the setting device being receivable in the longitudinally extending annular space when the cylindrical mandrel is retracted longitudinally upward through the catching assembly.

4. The apparatus of claim 1 further comprising the drag assembly being a drag block assembly and the one or more drag elements being a plurality of drag blocks.

5. The apparatus of claim 4 further comprising the catching assembly also including a plurality of slips positioned above the drag blocks.

6. The apparatus of claim 5 further comprising one or more slip engaging elements carried on the cylindrical mandrel and receivable under the slips for forcing the slips outwardly to an engagement position.

7. The apparatus of claim 6 further comprising, when the slot engaging element is at the first lower catch position of the slot and the cylindrical mandrel is then extended longitudinally downward through the catching assembly, the slot engaging element will be automatically stopped at the upper catch position of the slot so that the one or more slip engaging elements is/are retained above, and prevented from contacting, the slips.

8. A string assembly for a well comprising:

an electric submersible pump and a catching tool positioned in the string assembly below or above the electric submersible pump, the catching tool comprising a cylindrical mandrel having a longitudinal axis;

a catching assembly through which the cylindrical mandrel extends for sliding longitudinal movement of the cylindrical mandrel through the catching assembly, the catching assembly comprising a drag assembly comprising one or more drag elements which will contact a cased or an uncased portion of a bore of the well to resist downward and upward movement of the catching assembly in the well and a slot engaging element which is positioned longitudinally below the one or more drag elements;

a setting device, below the one or more drag elements, which is retained on and moves longitudinally with the cylindrical mandrel;

the slot engaging element being rotatable, with respect to the one or more drag elements, around the mandrel and/or the setting device being rotatable around the mandrel; and the setting device providing a slot which interacts with the slot engaging element by longitudinally retracting and extending the cylindrical mandrel through the catching assembly without requiring rotation of the mandrel so that (i) as the cylindrical mandrel is retracted longitudinally upward through the catching assembly, the slot engaging element is automatically received in an upper opening of the slot, (ii) as the cylindrical mandrel continues to be retracted longitudinally upward, the slot engaging element is automatically stopped at a first lower catch position of the slot, (iii) if the cylindrical mandrel is then extended longitudinally downward through the catching assembly, the slot engaging element is automatically stopped at an upper catch position of the slot, (iv) if the cylindrical mandrel is then retracted longitudinally upward through the catching assembly, the slot engaging element is automatically stopped at a second lower catch position of the slot, and (v) if the cylindrical mandrel is then extended longitudinally downward through the catching assembly, the slot engaging element will automatically travel out of the upper opening of the slot so that the slot engaging element is no longer positioned in the slot and the cylindrical mandrel can be further extended downwardly through the catching assembly.

9. The string assembly of claim 8 further comprising the catching tool being positioned in the string assembly below the electric submersible pump.

10. The string assembly of claim 8 further comprising:

the catching assembly also including a longitudinally extending control sleeve positioned below the one or more drag elements and around the cylindrical mandrel, a longitudinally extending annular space formed between an interior surface of the control sleeve and an exterior of the cylindrical mandrel, the longitudinally extending annular space surrounding the exterior of the cylindrical mandrel, the slot engaging element extending inwardly from the interior surface of the control sleeve toward the exterior of the cylindrical mandrel, and the setting device being receivable in the longitudinally extending annular space when the cylindrical mandrel is retracted longitudinally upward through the catching assembly.

11. The string assembly of claim 8 further comprising:

the drag assembly being a drag block assembly and the one or more drag elements being a plurality of drag blocks;

the catching assembly also including a plurality of slips positioned above the drag blocks; and the catching tool further comprising one or more slip engaging elements carried on the cylindrical mandrel and receivable under the slips to force the slips outwardly to an engagement position.

12. The string assembly of claim 11 further comprising the one or more slip engaging elements being a cone structure.

13. The string assembly of claim 11 further comprising, when the slot engaging element is at the first lower catch position of the slot and the cylindrical mandrel is then extended longitudinally downward through the catching assembly, the slot engaging element will be automatically stopped at the upper catch position of the slot so that the one or more slip engaging elements is/are retained above and prevented from contacting the slips.

14. A method of running and/or retrieving an electric submersible pump in a well, the well having an internal surface which is (i) an interior surface of a casing in the well or (ii) a wall of an uncased portion of a borehole of the well, and the method comprising steps of:

a) forming a string assembly comprising the electric submersible pump and a catching tool positioned below or above the electric submersible pump, the catching tool comprising
- a cylindrical mandrel having a longitudinal axis,
- a catching assembly through which the cylindrical mandrel extends for sliding longitudinal movement of the cylindrical mandrel through the catching assembly, the catching assembly comprising
  - a drag assembly comprising one or more drag elements which contact the internal surface of the well to resist downward and upward movement of the catching assembly in the well,
  - a plurality of slips positioned above the one or more drag elements, and
  - a slot engaging element which is positioned longitudinally below the one or more drag elements,
- a setting device, below the one or more drag elements, which is retained on and moves longitudinally with the cylindrical mandrel and provides a slot which interacts with the slot engaging element,
- one or more slip engaging elements carried on the cylindrical mandrel, the one or more slip engaging elements being receivable under the slips for forcing the slips outwardly against the internal surface of the well, and
- the slot engaging element being rotatable, with respect to the one or more drag elements, around the mandrel and/or the setting device being rotatable around the mandrel, b) longitudinally retracting the cylindrical mandrel upwardly through the catching assembly, without rotating the cylindrical mandrel, so that the slot engaging element is automatically received in an upper opening of the slot;

c) continuing to retract the cylindrical mandrel upwardly through the catching assembly, without rotating the cylindrical mandrel, until the slot engaging element automatically contacts and is stopped at a lower catch position of the slot which prevents the cylindrical mandrel from being further retracted upwardly through the catching assembly;

d) delivering the string assembly into the well such that, as the string assembly is delivered into the well and the one or more drag elements contact the internal surface of the well, the cylindrical mandrel extends downwardly through the catching assembly, without rotation of the cylindrical mandrel, until the slot engaging element automatically contacts and is stopped at an upper catch position of the slot; and then e) continuing to deliver the string assembly into the well with the slot engaging element being stopped at the upper catch position of the slot which (i) pulls the catching assembly downwardly into the well with the cylindrical mandrel and (ii) prevents the one or more slip engaging elements from moving into engagement with the slips.

15. The method of claim 14 further comprising the setting device being rotatable around the mandrel.

16. The method of claim 14 further comprising:
- the catching assembly also including a longitudinally extending control sleeve positioned below the one or more drag elements and around the cylindrical mandrel,
- a longitudinally extending annular space formed between an interior surface of the control sleeve and an exterior of the cylindrical mandrel, the longitudinally extending annular space surrounding the exterior of the cylindrical mandrel,
- the slot engaging element extending inwardly from the interior surface of the control sleeve toward the exterior of the cylindrical mandrel, and
- the setting device being received in the longitudinally extending annular space as the cylindrical mandrel is retracted longitudinally upward through the catching assembly in step (b).

17. The method of claim 14 further comprising the drag assembly being a drag block assembly and the one or more drag elements being a plurality of drag blocks.

18. The method of claim 14 further comprising the one or more slip engaging elements carried on the cylindrical mandrel being a cone structure.

19. The method of claim 14 further comprising:
- the lower catch position of the slot being a first lower catch position;
- delivering the catching assembly to a desired depth in the well in step (e);
- a step (f), following step (e), of retracting the cylindrical mandrel longitudinally upward through the catching assembly, without rotating the cylindrical mandrel, until the slot engaging element is automatically stopped at a second lower catch position of the slot;
- a step (g), following step (f), of extending the cylindrical mandrel longitudinally downward through the catching assembly, without rotating the cylindrical mandrel, so that the slot engaging element automatically travels out of an upper opening of, and is no longer position in, the slot; and
- a step (h), following step (g), of continuing to extend the cylindrical mandrel longitudinally downward through the catching assembly to lower the one or more slip engaging elements to a position which is closer to the catching assembly but at which the one or more slip engaging elements are spaced apart from and do not engage the slips.

20. The method of claim 19 further comprising steps, following step (g), of retrieving the string assembly from the well by:
- pulling the cylindrical mandrel longitudinally upward through the catching assembly, without rotation of the cylindrical mandrel, so that the slot engaging element is automatically received in the upper opening of the slot;
- continuing to pull the cylindrical mandrel upwardly, without rotating the cylindrical mandrel, so that the slot engaging element is automatically received at the first lower catch position of the slot to prevent the cylindrical mandrel from being further retracted longitudinally upward through the catching assembly; and then continuing to pull the cylindrical mandrel upwardly with the slot engaging element being caught at the first lower catch position of the slot which (i) pulls the catching assembly upwardly and (ii) lifts the string assembly out of the well.

* * * * *